United States Patent [19]

Albert et al.

[11] 4,182,492

[45] Jan. 8, 1980

[54] HYDRAULICALLY OPERATED PRESSURE AMPLIFICATION SYSTEM FOR FUEL INJECTORS

[75] Inventors: Albert A. Albert, Bellevue; Kenneth W. Porter, Mercer Island, both of Wash.

[73] Assignee: Combustion Research & Technology, Inc., Tukwila, Wash.

[21] Appl. No.: 869,517

[22] Filed: Jan. 16, 1978

[51] Int. Cl.[2] ..... F02M 47/02

[52] U.S. Cl. ..... 239/92; 239/95; 123/139 E

[58] Field of Search ..... 239/88–92, 239/95; 123/32 B, 32 JV, 139 AK, 139 AN, 139 E

[56] References Cited

U.S. PATENT DOCUMENTS

| | | | |
|---|---|---|---|
| 2,598,528 | 5/1952 | French | 239/92 X |
| 3,689,205 | 9/1972 | Links | 123/139 E |
| 3,921,604 | 11/1975 | Links | 123/139 E |
| 3,961,612 | 6/1976 | Okamoto et al. | 123/139 E |
| 4,069,800 | 1/1978 | Kanda et al. | 123/139 E |

*Primary Examiner*—John J. Love

*Attorney, Agent, or Firm*—Cole, Jensen & Puntigam

[57] ABSTRACT

A hydraulically operated fuel injector for compression-ignition engines which includes an electronically or pneumatically operated hydraulic pilot-control valve which is supplied with fuel under substantially constant pressure from a pump driven directly or indirectly by the engine. The pilot-control valve is connected by supply and exhaust passages to a slave valve which in turn controls the admission of fuel to a charging cavity located adjacent to an outlet valve to the combustion chamber. The slave valve is a stepped diameter piston which functions as a pressure amplifier for the fuel supply to the combustion chamber. Fuel from the pump which is received at relatively low pressure through the slave valve is amplified to high pressures sufficient to overcome compression and combustion pressures of the engine and the resistance of spring seated injector outlets and/or the fuel supply orifice(s).

8 Claims, 4 Drawing Figures

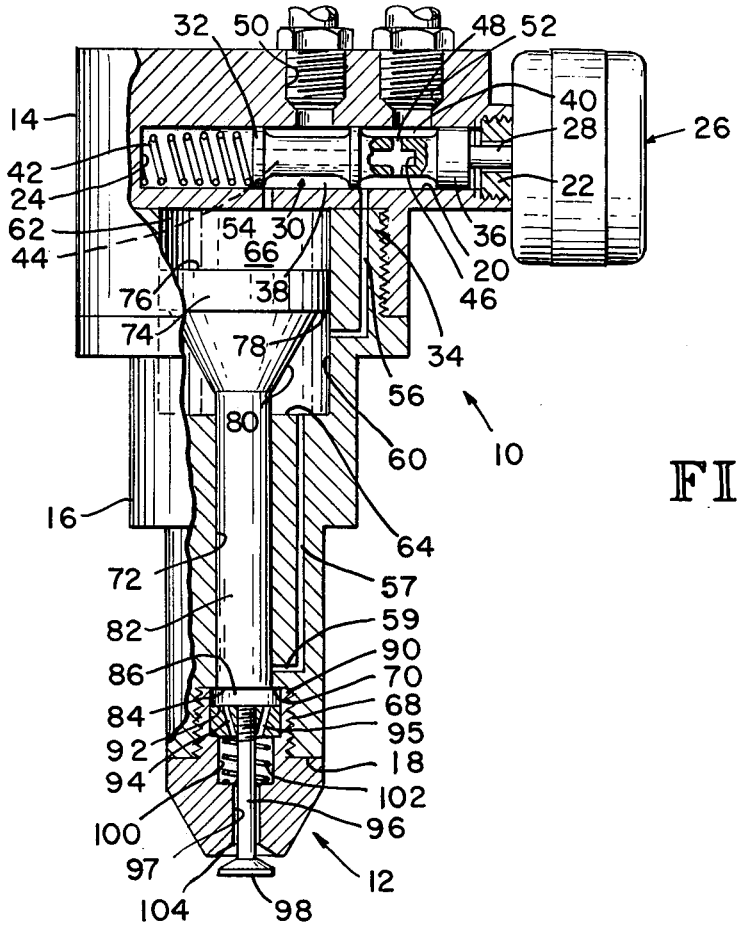
FIG. 1
FIG. 2
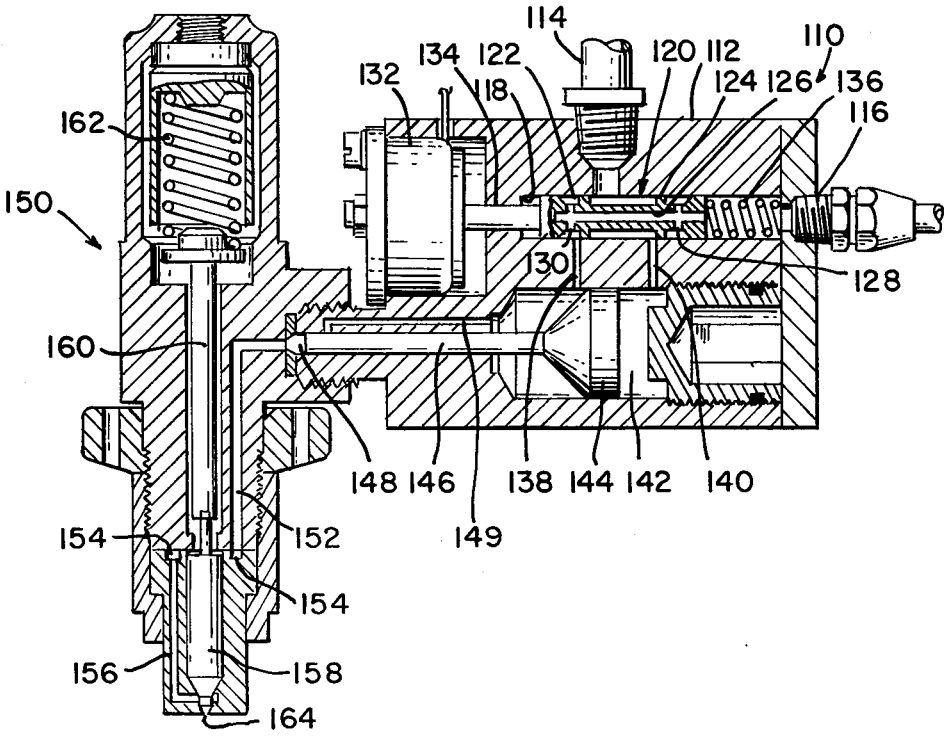

HYDRAULICALLY OPERATED PRESSURE AMPLIFICATION SYSTEM FOR FUEL INJECTORS

BACKGROUND OF THE INVENTION

This invention relates generally to the area of internal combustion engine fuel injectors and more particularly to an electronically controlled, hydraulically actuated pressure amplification device for compression-ignition engine fuel injectors.

Those skilled in the art are aware that fuel injection systems are an essential element of design and application for compression-ignition engines which rely on the high temperature of a rapidly substantially adiabatically, compressed charge of air to provide spontaneous ignition of a charge of fuel introduced near the maximum compression point of the cycle. To complete as fully as possible the combustion process, it is necessary to develop a sufficiently high fuel injection pressure external to the cylinder to overcome the pressure within the engine cylinder, and to rapidly inject the fuel at the most advantageous time in the cycle. It is well known that a certain proportion of the fuel charge may be introduced early in the compression stroke to facilitate evaporation and assist the propagation of the flame front after ignition occurs. However, this so-called multi-phase injection is difficult to achieve with mechanically operated fuel injection systems.

The heretofore predominant method used for injecting fuel is the mechanical/hydraulic plunger driven by cam shaft means in fixed mechanical relationship to the angular position of the engine crankshaft. The plungers are alternatively located in injector cylinders adjacent to the engine combustion chambers or remotely located in a fuel injection pump separately mounted on the engine and driven through gear and shaft means.

Existing commercial automotive diesel engines traditionally have been equipped with fuel injection equipment based on the principles of the Bosch system. In the Bosch system, a mechanically driven cam shaft causes a plunger to reciprocate within a finely ground and lapped cylinder barrel and eject a predetermined amount of fuel oil under high pressure through several small exist holes of an injector nozzle into the engine combustion chamber beginning near the time of top dead center position of the crank throw. The fuel is broken up or "atomized" by the injection process and is sprayed as droplets, within the combustion chamber in a penetration pattern which is dependent upon the size of the injector holes and their orientation. The droplets are then vaporized and ignited by the air movement and temperature of the compressed charge. Combustion is completed by the swirl or motion of air flow patterns which are a function of the design of the cylinder head and valve gear, the piston cavity design, and other cylinder-to-cylinder variables as those skilled in the art are aware.

The design arrangement for the location of the fuel injectors varies according to the manufacturer. A jerk type injection pump may be located removely from the cylinder head and supply the fuel under high pressures through thick wall tubing to the injectors. Alternatively, the fuel injector cam shaft may be integrated with the air intake poppet valve camshaft and/or exhaust valve camshaft(s) to actuate the fuel injectors directly.

In the prior art, the fixed mechanical relationship and dependence of injector actuation and timing on the design of camshaft lobes and gear drive mechanisms requires the use of complex control features for precise control of variable speed/variable power engines. These control features adjust the supply of fuel for a single injection of fuel per cycle per cylinder for accommodation of variable load conditions at fixed engine speed, for acceleration of coupled masses to operating speeds, for control of overrun or overshoot, and for fuel-air enrichment needed under starting conditions. The fuel injector plunger barrels are sometimes rotatable by a rack and pinion mechanism and by mechanical flyball governing systems which vary the admission and fuel injection cutoff timing by means of controllable sleeve valve port opening arrangements. Adjustments for variation in fuel density or for operation at altitudes usually are also provided.

The mechanical design arrangements and control mechanisms heretofore known and in use today represent a compromise between the ideal of instant and precise response to load demand variation for each engine cylinder under all operating conditions on the one hand, and the practical consideration of injection equipment cost, serviceability and maintainability on the other. They do not commonly accommodate multiphase injection. Wear of mechanical fuel injection equipment, including cams, roller followers, plungers and barrels, governor linkages, and control rods and bearings, all contribute to the frequent need for repair and maintenance by skilled personnel to avoid damage, loss of performance and excessive or deleterious emissions.

Among the patents which may be considered of interest only relative to this invention are U.S. Pat. Nos. 3,961,612; 3,257,078; 3,752,137; and 3,587,547.

SUMMARY OF THE INVENTION

Hydraulically operated, pressure amplification mechanism for fuel injection including a hydraulic pilot control valve. The pilot control valve is supplied with fuel under substantially constant, relatively low pressure from a pump driven directly or indirectly by the engine. The pilot control valve is connected through both supply and exhaust passages to a slave valve in the form of a piston which acts as a pressure amplifier. The incoming low pressure fuel is supplied to an injector cavity located adjacent to an outlet valve to the combustion chamber. The slave or amplifier valve includes a piston so that the relatively low pressure fuel acts on a larger area piston connected to a smaller area plunger which in turn acts to multiply or amplify the pressure in a fuel charging chamber at the end of the plunger. In effect, the areas are subjected intermittently and simultaneously to fuel supply pressure on the driving major area and fuel injection pressure on the minor area. The minor area cavity on which the amplifier plunger operates is open to the injector outlet; and the pressure amplification is such that the fuel supply pressure is increased by a factor sufficient to overcome the compression and combustion pressures of the engine and the resistance of spring seated injector outlet valves and/or offices. Typically, the amplifier may increase a moderate fuel supply pressure of 250 lbs. per square inch to the high injection pressure of perhaps 5,000 pounds per square inch within the body of the injector.

Accordingly, it is among the features and advantages and objects of the instant invention to provide a hydraulically actuated, pressure amplification system for fuel injectors by replacing the current fixed mechanical relationships for injector timing or sequence with an electro-hydraulically operated, fuel pressure amplifier which is capable of injecting a plurality of precisely metered amounts of fuel under very high pressure differentials during the compression and power strokes. The invention will permit the advancing of the injection of fuel with respect to the rotational position of the crankshaft as engine speed increases to compensate for the decreased time available for burning of the fuel charge. It will allow for varying the duration of time that fuel is injected during the combustion cycle, and will permit earlier or later fuel cutoff to accommodate desired variations in the engine power output.

The invention will use a safe or moderate pressure fuel source external to the engine. Fuel supply pressure will be highly amplified within the fuel injector enabling the injector to deliver a more finely atomized fuel spray than heretofore in general use in order to improve the vaporization and combustion process. A controlled variable amount of fuel may be preinjected early in the compression stroke of the engine cycle to facilitate and improve the combustion characteristic modes.

Accordingly, the invention allows for more efficient and economical use of available fuel supplies. It lowers the specific fuel consumption because of the more complete combustion obtainable with this system. It reduces emission, smoke and noise and it allows for lighter weight engine fuel system design.

The amplification system can be adapted to existing injectors without requiring any modification to the engine cylinder heads.

Fuel supply pressure at a moderate pressure level is maintained up to the charging chamber at the foot of the slave valve plunger. This reduces equipment initial cost and also operating and maintenance costs. The system will allow for improved acceleration response to load demand and faster and more reliable starting performance in the engine. The system will also contribute to improved cold weather operation, improved idle characteristics, freedom from hunting and searching instabilities, improved traffic flow and greater highway uses and operator safety. The system may be used as an electro-hydraulically operated injector for fluids requiring transfer between containers subject to high pressure differentials, as a pressure amplifier for injection of fluids into a high pressure environment, and as a servo valve for conversion of low pressure source supply fluid to high pressure actuator supply fluid.

BRIEF DESCRIPTION OF THE DRAWINGS

FIG. 1 is a cross-sectional view of an embodiment of the invention as it would be incorporated with the assignee's style of Diesel fuel injector;

FIG. 2 is a cross-sectional view which shows an embodiment of the invention adapted to a CAV-Bosch type injector;

DESCRIPTION OF PREFERRED EMBODIMENT

Figure 3:
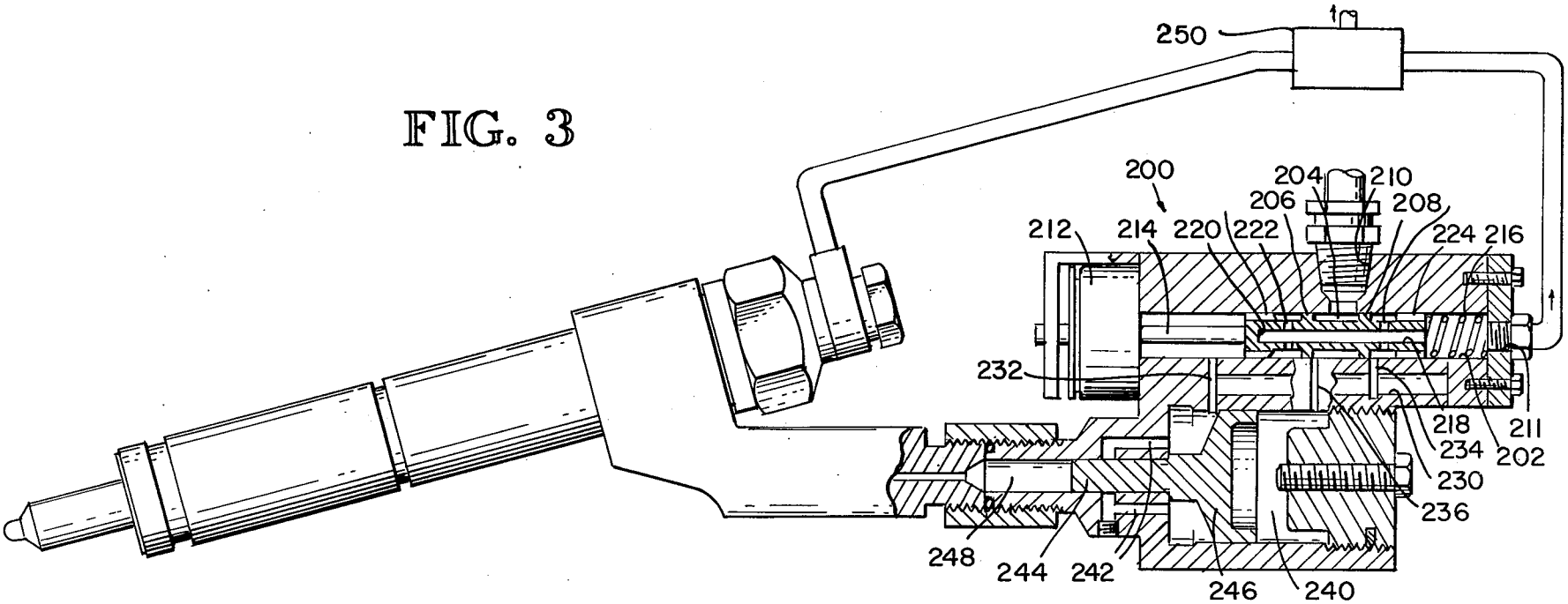
FIG. 3 is a cross-sectional view of an embodiment of the invention as it would be adapted to a Bosch type injector.

It will be seen by reference to the embodiment of FIG. 1 that the pressure amplifier, generally designated by the number 10, includes an injector tip 12 which is more particularly described and claimed in a co-pending U.S. patent application Ser. No. 781,766 which is assigned to the assignee of the instant application. This embodiment of the invention includes an upper housing or casing 14 and an elongated or lower housing section 16, said lower section 16 having a lower end 18. Within the upper section 14 is a pilot control valve bore 20 which has an open outer end 22 and a closed inner end 24. At the outer end 22 a soldnoid 26 is attached which has a core 28 extending into the valve bore 20.

An elongated spool valve, generally designated by the number 30 is shown disposed within the bore 20 and has an inner land 32, an intermediate land 34 and an outer land 36. A reduced diameter spool valve supply portion 38, defining an annular supply chamber, is located between inner land 32 and intermediate land 34. A return valve portion of reduced diameter 40 is located between the intermediate land 34 and the outer land 36 to define an annular fuel exhaust cavity. A compression spring 42 is located between the end wall 24 of the bore and the outer wall of inner land 32, thus urging the spool 30 against the soldnoid core 28. It will be noted that spool 30 is provided with an internal passage 44 shown in doted lines which opens into that area of the bore occupied by compression spring 42. The passage 44 extends centrally through the spool and into the reduced diameter return section 40 and terminates generally as shown at an inner wall 46. A lateral passage 48 also shown in the dotted lines opens from central passage 44 into the return cavity as defined by the reduced diameter 40 of the spool 30.

A fuel inlet opening 50 opens through the housing into the supply cavity defined by the reduced portion 38 of spool 30. In like manner, a fuel return opening 52 opens through the casing and into the return cavity defined by reduced portion 40 of spool 30. Fuel transfer passages 54 and 56 are provided in the housing 14 and they will be described in greater detail hereinafter. The upper body section 14 and the lower body section 16 of the invention together define amplifier piston chamber 66 having a cylinder wall 60, a top wall 62, and a bottom wall 64.

As can be seen, the lower housing section 16 is elongated to its lower end 18 which lower end has internal threads 68 for receiving injector tip 12. Between chamber 66 and a recessed radially outwardly offset wall 70 to which the internal threads 68 extend is a plunger guide passage 72. Disposed within chamber 66 and guide passage 72 are amplifier piston head 74 having upper surface 76 and bottom surface 78 which tapers as at 80 to the plunger section 82 which extends through guide passage 72 and terminates at its lower end 84.

The lower end 84 of plunger section 82 and the inside of the recessed wall 70 of the body portion 16 together with the upper end surface of the injector tip 12 define a fuel pressure charging chamber 86.

In addition to supply passage 56 which communicates between the spool valve bore 20 and chamber 66 there is also provided fuel passage 57 extending from the lower end of the chamber 66 to a location just above recessed wall 70 in the guide passage 72.

Tip 12, reference again being had to co-pending U.S. patent application Ser. No. 781,766, includes an upper end 90 which is spaced from the recessed wall 70 of the housing 10. A first cavity 92 is formed in the upper end of the tip 12 to receive a valve retaining nut 94. Valve retaining nut 94 is threadably engaged with valve stem 96 having at its lower end a valve head 98. Below first cavity 92 is a spring cavity 100 which is of slightly smaller diameter than first cavity 92. Thus there is formed an annular, offset upwardly exposed surface between the two cavities which forms a stop surface for nut 94 which has openings 95 extending therethrough. A spring 102 in cavity 100 acts to normally bias the nut upwardly and thus to pull the head 98 upwardly against the seat surface 104 to keep the valve closed. Fuel channels 97 extend from the spring cavity down along the stem 96 to open at the lower end 104 of the tip.

Operation of the actuator-amplifier will now be described. Diesel fuel under pressure of approximately 250 PSI enters the hydraulic actuator through opening 50 and into the annular cavity between the inner and intermediate lands of the spool 30. With the solenoid 26 de-energized the compression spring 42 forces the spool into a position to the right of that shown in the drawing, that is with the inner most land 32 to the right hand side of fuel passage 54 which opens into piston chamber 66. In like manner, the intermediate land 34 is to the right of fuel passage 56 so that the fuel as it enters the spool or pilot valve bore is directed through passage 56 to the underside of piston head 74 and also into passage 57. The pressure so directed will force the slave valve piston and plunger upwardly so that the lower end 84 of the plunger is above the passage 59 which opens into the plunger guide passage 72 and thus into the fuel charging chamber 86. In this way, fuel is directed and occupies the spring cavity 100, the charging cavity 86 and the area of chamber 66 on the underside of the piston which has its uppermost position higher in cavity 66 than is shown. Upon actuation of soldnoid 26 by the electronic controls the spool or pilot valve is moved to the left against spring 42 so that passage 54 now registers with the annular chamber of the spool valve which connects to incoming fuel supply passage 50.

The pressure entering the chamber 66 on the top side of the piston through passage 54 forces the piston downwardly. At the same time, that the spool moves to the left intermediate land 34 is to the left of passage 56 allowing fuel on the underside of the piston to exit through passage 56 and into the exit or return annular chamber between the intermediate land 34 and the outer land 36. The fuel being discharged from the underside of the piston thus enters the return or exit line 52. As the plunger 82 moves down it passes passage 59 thus closing off the charging chamber 86 so that the fuel is confined. The area differential between the upper surface 76 of piston 74 and the area of the lower end 84 of the plunger 82 operates to amplify the pressures in the charging chamber by the amount of the area differential. For purposes of illustration, it may be assumed that the area difference is twenty to one thus multiplying or amplifying the pressure in the charging chamber 86 from 250 lbs. to 5000 lbs. pressure which is sufficient pressure to inject fuel into the combustion chamber. Amplified pressure in the charging chamber 86 overcomes the resistance of spring 102 and forces the retaining nut 94 and stem valve 96 down such that fuel passes through the retaining nut passages 95, through the spring cavity and downwardly through fuel channels 97 so the fuel can be injected out of the tip and into the combustion chamber. As soon as the solenoid 26 is de-energized the pilot valve spring 42 forces the spool to the right so that again the incoming pressure side of the spool registers with passage 56 to force the piston up. As the piston moves up and since the innermost land 32 is to the right of passage 54 the fuel that is accumulated above the piston is able to exit out through passage 54, into the bore 20 of the pilot valve and thence through the internal passage 44 of the spool and out transverse passage 48 into the return opening or line 52.

It is to be understood that while the ratio of 20 to 1 of piston area to plunger area has been used, such ratio may vary depending upon a number of variables. Since the solenoid is energized by electronic controls the amount of fuel injected and the timing of the injection can be precisely controlled. The high injection pressures are generated at the charging chamber so that the substantially lower and more moderate pressures generated by the pump are effectively utilized up to the charging chamber 86.

Referring now to FIG. 2, the hydraulic actuator and pressure amplifier is hown in conjunction with a more conventional CAV type injector thus illustrating the adaptability of the mechanism to known injectors. The actuator/amplifier, generally designated by the number 110, includes housing 112 with low pressure inlet 114 and return or exhaust line 116. The pilot or spool valve bore 118 includes spool 120 with spaced apart lands 122 and 124. An internal passage 126 extends entirely through the spool and in this particular embodiment includes transverse openings 128, 130 from internal passage 126 to the annular cavities outside the lands. The ends of the spool are enlarged as shown. A solenoid 132 has solenoid core 134 which engages one end of the spool and compression spring 136 at the other end of the bore to control the movement and location of the spool. Transfer passages 138 and 140 enter the piston cavity 142 below and above piston 144 respectively. As shown, plunger 146 extends from piston 144 to charging chamber 148. Note that a fuel supply passage 149 leads from the lower end of the piston chamber to a point just above the charging chamber end of plunger 146.

The injector 150 is of conventional design and therefore well known in the art. The hydraulic actuator and amplifier of this invention is able to be readily adapted thereto. Functioning as described above, the actuator-/amplifier 110 forces fuel under high pressure from the charging chamber 148 through injector passage 152 to an annular chamber 154. The fuel proceeds then from the annular chamber 154 through passage 156 to the tapered lower end of pintle 158. The high pressure fuel acting on the tapered lower surface of pintle 158 forces the pintle which is connected to the connecting rod 160, against the resistance of spring 162. As the pintle and connecting rod move upwardly against the spring pressure, fuel is injected at high pressure through the tip orifice(s) 164 into the combustion chamber.

FIG. 3 shows the invention adapted to a Bosch type injector which is also well known in the Diesel art. The actuator amplifier 200 includes spool or pilot control valve bore 202 having a spool 204 disposed therein. The spool includes spaced apart lands 206 and 208 between which are located the fuel incoming or supply annular chamber which receives fuel from inlet 210. Solenoid 212 having actuator core 214 together with spring 216 control the location and movement of spool 204. In this instance, spool 204 has an internal passage 218 extending from the outlet end 211 of the spool to terminate at its inner end 220 as shown in the drawing. The spool also has enlarged but in this case fluted ends 222 and 224 allowing fuel to pass the fluted ends. Also the spool is provided with transverse passages 226 and 228 respectively outside the lands 206 and 208 but inside the fluted ends 222 and 224. A transfer passage 230 is located generally parallel to and in spaced relation to the pilot valve bore 202 and extends over sufficient distance to allow a cross passage 232 and a communicating passage 234 to function in the manner which will be described hereinafter. A third passage 236 extends from the spool bore into the upper part of piston chamber 240 but without communicating with the transfer passage 230. Note that the cross passage 232 communicates with the lower end of piston chamber 240. Passages 242 connect from the lower part of the piston chamber into the guide passage for plunger 244 of piston 246. Charging chamber 248 is located at the lower end of the plunger 244 where the highly pressurized fuel may then be directed into the injector which functions in much the same manner as the injector shown in FIG. 2. Again, the arrangement of passages in the actuator amplifier are such as to permit the incoming fuel to be directed to either below or above the piston for movement of the piston as desired and of couse, to allow a fuel return route from above or below the piston. Excess fuel may be directed from the injector itself and from the pilot valve bore through outlet 211 to a common junction 250 for return of the fuel to the fuel supply.

Figure 4:
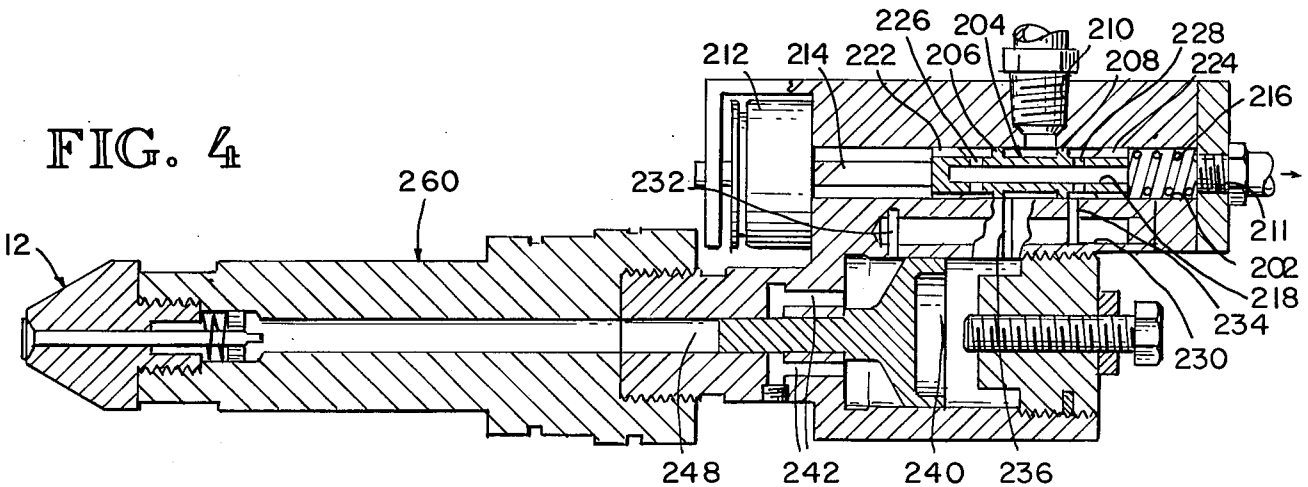
FIG. 4 shows an embodiment of the invention as it might be modified for fuel injection into a Cummins type engine.

FIG. 4 shows essentially the same structural form of the actuator/amplifier in FIG. 3 but in conjunction with an adapter mechanism 260 for use in a Cummins engine. The adapter 260 is provided with an injector tip 12 as shown and described in FIG. 1. For all practical purposes the actuator/amplifier is the same as that shown in FIG. 3 and further illustrates the flexibility and adaptability of the actuator/amplifier to known types of diesel engines and existing injectors.

Control of the actuator and pressure amplifier allows fuel injection timing to be optimally advanced and retarded as required to accommodate engine acceleration or deceleration on other changing load or speed conditions. Furthermore, the duration of injection or the amount of fuel injected can be precisely regulated according to engine load conditions or operator demands. Also, there can be multiphase injection, as for instance preinjecting a portion of a fuel charge to the engine cylinders shortly after closure of the intake valves to allow greater time duration for better air-fuel mixing and thereby facilitating more complete combustion.

What is claimed is:

1. A fluid injector actuator and pressure amplification mechanism for an injector, comprising:

(a) an injector valve device for injection of fluids into a high pressure atmosphere, (b) an actuator/amplifier housing connected to said injector valve device and including a pilot control valve section having a fluid inlet opening for admission of pressurized fluid thereto and a fluid exhaust opening for exiting of fluid therefrom, said pilot control valve further being connected by fluid transfer passages to and adapted to control flow of pressurized fluid to and from a pressure amplifier valve section, said pilot control valve also having a first position for effecting an actuation mode in an amplifier valve and a second position for effecting a reset mode in said amplifier valve, and further including actuator means for control of said pilot control valve, (c) said housing also containing an amplifier valve section operatively connected to said pilot control valve by said fluid transfer passages for receiving pressurized fluid from said pilot valve, and including a fluid charging chamber area in which the pressure of said fluid is amplified by a predetermined amount to a high pressure, said amplifier valve having an actuation mode for amplifying said fluid pressure and a reset mode for readying the same for its actuation mode, (d) connecting passage means from said fluid charging chamber of said amplifier valve section connected to said injector valve device so that upon actuation of said amplifier valve section to its actuation mode by said pilot control valve, high pressure fluid is transmitted to said injector valve device which in turn is actuated by said high pressure fluid and injects high pressure fluid into said high pressure atmosphere, (e) said pilot control valve including an elongated bore and an elongated movable member disposed for axial movement therein, said movable number being engaged by said actuator means at one end and also engaged by resilient means urging said movable member toward said actuator means such that location and movement of said movable member to said first position and to said second position are determined by said resilient means and said actuator means, said movable member being a spool having spaced apart lands defining an annular first cavity means for receiving fluid from said fluid inlet and defining an annular second cavity means for returning fluid to said exhaust opening, and (g) said spool including a central axial passage opening out of and extending from one end of and through the spool and terminating in closed spaced relationship to the other end thereof and further including at least one transverse passage opening from said central passage into said second cavity for returning fluid to said exhaust opening.

2. A fluid injector actuator and pressure amplification mechanism for an injector, comprising:

(a) an injector valve device for injection of fluids into a high pressure atmosphere, (b) an actuator/amplifier housing connected to said injector valve device and including a pilot control valve section having a fluid inlet opening for admission of pressurized fluid thereto and a fluid exhaust opening for exiting of fluid therefrom, said pilot control valve further being connected by fluid transfer passages to and adapted to control flow of pressurized fluid to and from a pressure amplifier valve section, said pilot control valve also having a first position for effecting an actuation mode in an amplifier valve and a second position for effecting a reset mode in said amplifier valve, and further including actuator means for control of said pilot control valve, (c) said housing also containing an amplifier valve section operatively connected to said pilot control valve by said fluid transfer passages for receiving pressurized fluid from said pilot valve, and including a fluid charging chamber area in which the pressure of said fluid is amplified by a predetermined amount to a high pressure, said amplifier valve having an actuation mode for amplifying said fluid pressure and a reset mode for readying the same for its actuation mode, (d) connecting passage means from said fluid charging chamber of said amplifier valve section connected to said injector valve device so that upon actuation of said amplifier valve section to its actuation mode by said pilot control valve, high pressure fluid is transmitted to said injector valve device which in turn is actuated by said high pressure fluid and injects high pressure fluid into said high pressure atmosphere, (e) said fluid transfer passages being spaced apart passages leading from said pilot control valve such that when fluid under pressure in one is being directed to said pressure amplifier valve, the other of said pair is being used to return fluid from said pressure amplifier valve, and (f) one of said pair of transfer passages leads from said pilot control valve to said piston chamber above said piston and the other of said pair of transfer passages leads from said pilot control valve to said piston chamber below said piston so as to effect reciprocating movement of said piston and plunger member such that fluid under pressure above said piston causes an actuation mode and fluid under pressure below said piston causes a reset mode of said pressure amplifier.

3. A fluid injector actuator and pressure amplification mechanism for an injector, comprising:

(a) an injector valve device for injection of fluids into a high pressure atmosphere, (b) an actuator/amplifier housing connected to said injector valve device and including a pilot control valve section having a fluid inlet opening for admission of pressurized fluid thereto and a fluid exhaust opening for exiting of fluid therefrom, said pilot control valve further being connected by fluid transfer passages to and adapted to control flow of pressurized fluid to and from a pressure amplifier valve section, said pilot control valve also having a first position for effecting an actuation mode in an amplifier valve and a second position for effecting a reset mode in said amplifier valve, and further including actuator means for control of said pilot control valve, (c) said housing also containing an amplifier valve sectionoperatively connected to said pilot control valve by said fluid transfer passages for receiving pressurized fluid from said pilot valve, and including a fluid charging chamber area in which the pressure of said fluid is amplified by a predetermined amount to a high pressure, said amplifier valve having an actuation mode for amplifying said fluid pressure and a reset mode for readying the same for its actuation mode, (d) connecting passage means from said fluid charging chamber of said amplifier valve section connected to said injector valve device so that upon actuation of said amplifier valve section to its actuation mode by said pilot control valve, high pressure fluid is transmitted to said injector valve device which in turn is actuated by said high pressure fluid and injects high pressure fluid into said high pressure atmosphere, (e) said pressure amplifier valve consisting of a piston chamber of predetermined larger diameter and a small diameter plunger guide passage extending generally centrally therefrom and further including a piston and plunger member disposed in said piston chamber and plunger guide passage such that said charging chamber is located at the end of said plunger, and (f) a fluid charging supply passage interconnects the lower part of said piston chamber and said charging chamber such that when the piston and plunger member is in its uppermost or reset position said charging supply passage is open to said charging chamber and when said piston and plunger member has moved into a downward or actuation mode said charging supply passage is closed off by said plunger from said charging chamber.

4. A fuel injector actuator and fuel pressure amplification mechanism for a compression-ignition engine fuel injector, comprising:

(a) an injector valve device operatively connected to an internal combustion engine cylinder for injection of fuel into the combustion chamber thereof, (b) an actuator/amplifier housing connected to said injector valve device and including a pilot control valve section having a fuel inlet opening for admission of pressurized fuel thereto and a fuel exhaust opening for exiting of fuel therefrom, said pilot control valve further being connected by fuel transfer passages to and adapted to control flow of pressurized fuel to and from a pressure amplifier valve section, said pilot control valve also having a first position for effecting an actuation mode in an amplifier valve and a second position for effecting a reset mode in said amplifier valve, and further including actuator means for control of said pilot control valve, (c) said housing also containing an amplifier valve section operatively connected to said pilot control valve by said fuel transfer passages for receiving pressurized fuel from said pilot valve, and including a fuel charging chamber area in which the pressure of said fuel is amplified by a predetermined amount to a high pressure said amplifier valve having an actuation mode for amplifying said fuel pressure and a reset mode for readying the same for its actuation mode, (a) connecting passage means from said fuel charging chamber of said amplifier valve section connected to said injector valve device so that upon actuation of said amplifier valve section to its actuation mode by said pilot control valve, high pressure fuel is transmitted to said injector valve device which in turn is actuated by said high pressure fuel and injects high pressure fuel into the combustion chamber of said engine cylinder, (e) said pilot control valve including an elongated bore and an elongated movable member disposed for axial movement therein, said movable number being engaged by said actuator means at one end and also engaged by resilient means urging said movable member toward said actuator means such that location and movement of said movable member to said first position and to said second position are determined by said resilient means and said actuator means, (f) said movable member being a spool having spaced apart lands defining an annular first cavity means for receiving fuel from said fuel inlet and defining an annular second cavity means for returning fuel to said exhaust opening, and (g) said spool including a central axial passage opening out of and extending from one end of and through the spool and terminating in closed spaced relationship to the other end thereof and further including at least one transfer passage opening from said central passage into said second cavity for returning fuel to said exhaust opening.

5. The fuel injector actuator and pressure amplifier according to claim 4 and in which said fuel transfer passages are a pair of spaced apart passages leading from said pilot control valve such that when fuel under pressure in one is being directed to said pressure amplifier valve, the other of said pair is being used to return fuel from said pressure amplifier valve.

6. The fuel injector actuator and pressure amplifier according to claim 5 and in which said pressure amplifier valve consists of a piston chamber of predetermined larger diameter and a smaller diameter plunger guide passage extending generally centrally therefrom and further including a piston and plunger member disposed in said piston chamber and plunger guide passage such that said charging chamber is located at the end of said plunger.

7. The fuel injector actuator and pressure amplifier according to claim 6 and in which one of said pair of transfer passages leads from said pilot control valve to said piston chamber above said piston and the other of said pair of transfer passages leads from said pilot control valve to said piston chamber below said piston so as to effect reciprocating movement of said piston and plunger member such that fuel under pressure above said piston causes an actuation mode and fuel under pressure below said piston causes a reset mode of said pressure amplifier.

8. The fuel injector actuator and pressure amplifier according to claim 7 and in which a fuel charging supply passage interconnects the lower part of said piston chamber and said charging chamber such that when the piston and plunger member is in its uppermost or reset position said charging supply passage is open to said charging chamber and when said piston and plunger member has moved into a downward or actuation mode said charging supply passage is closed off by said plunger from said charging chamber.

* * * * *